United States Patent [19]

Nakamine

[11] Patent Number: 4,586,034

[45] Date of Patent: Apr. 29, 1986

[54] COLOR CODED COPIER DISPLAY

[75] Inventor: Chosin Nakamine, Okinawa, Japan

[73] Assignee: Tokyo Shibaura Denki Kabushiki Kaisha, Kawasaki, Japan

[21] Appl. No.: 448,474

[22] Filed: Dec. 10, 1982

[30] Foreign Application Priority Data

Dec. 26, 1981 [JP] Japan ..... 56-213025

[51] Int. Cl.[4] ..... G08B 21/00

[52] U.S. Cl. ..... 340/679; 340/674; 340/691; 340/701; 340/815.1

[58] Field of Search ..... 340/679, 674, 691, 715, 340/701, 815.1

[56] References Cited

U.S. PATENT DOCUMENTS 3,798,596 3/1974 Sumiyoshi et al. ..... 340/691
4,390,872 6/1903 Murakami et al. ..... 340/679
4,475,806 10/1984 Daughton et al. ..... 340/715

FOREIGN PATENT DOCUMENTS 1449043 12/1962 Fed. Rep. of Germany .
3247871 12/1982 Fed. Rep. of Germany .

*Primary Examiner*—Glen R. Swann, III
*Attorney, Agent, or Firm*—Cushman, Darby & Cushman

[57] ABSTRACT

A display device has a display panel in which patterns are impressed in conformity to the layout of a master instrument. With this display device, a pattern indicating a prescribed condition of the master instrument which is to be detected and a pattern representing a countermeasure for the prescribed condition are impressed on the display panel. Patterns related to the conditions of the master instrument which can be coped with without cutting off a power switch are displayed in a first color and patterns related to the conditions of the instrument which cannot be coped with unless the power switch is cut off are displayed in a second color. When particular conditions of the master instrument are detected, then patterns denoting the detected conditions and patterns representing countermeasures for the detected conditions are visually indicated to teach the operator to take a proper action.

4 Claims, 63 Drawing Figures

COLOR CODED COPIER DISPLAY

BACKGROUND OF THE INVENTION

This invention relates to a display device, and more particularly to a display device which visually indicates the abnormal condition of an apparatus, for example, an electronic copying machine, and the countermeasures therefor.

To date, there has already been commercially manufactured a device for displaying the number of sheets in which an impression has already been copied and another device which visually informs the operator of the condition in which some section of the copying machine is jammed with copying sheets. Pictorial patterns or notations representing those conditions of a copying machine which have to be detected are impressed on the transparent display panel of the display device. Some detected condition of a copying machine is displayed by illuminating the corresponding pictorial pattern or notation by a lamp provided at the back of the display panel. The operator takes proper countermeasures by looking at one displayed condition. Said countermeasures can be easily taken by a well-skilled copying machine operator. However, novice operators of said copying machine or those unaccustomed to its operation find difficulties in taking proper countermeasures. Therefore, the novice operator will have to be informed of countermeasures for the current condition of a copying machine by looking at an accompanying explanatory note. If the explanatory note is not easily available, the operator will have to ask for the advice from a skilled copying machine operator on the countermeasures to be taken. If the novice operator tries to take countermeasures only from his own doubtful knowledge, then the copying machine will probably be damaged.

SUMMARY OF THE INVENTION

It is accordingly the object of this invention to provide a display device which displays the patterns in a first color which are designed to indicate a condition of a master instrument which can be coped with without cutting off a power switch and a countermeasure for the condition, and which also displays the patterns in a second color which are designed to indicate a condition of the master instrument which cannot be coped with unless the power switch is cut off and a countermeasure for the condition.

To attain the above-mentioned object, this invention provides a display device which comprises:

a plurality of detection means for finding a prescribed condition of an instrument; condition-detecting means which is connected to said detection means and judges a particular condition of the instrument from an output signal from said detection means; display signal forming means which is connected to said condition-detecting means and produces upon receipt of an output signal from said condition-detecting means a signal for displaying the patterns in a first color which are designed to indicate a condition of a master instrument which can be coped with without cutting off a power switch and a countermeasure for said condition and a signal for displaying the patterns in a second color which are designed to indicate a condition of the master instrument which cannot be coped with unless the power switch is cut off and a countermeasure for said condition; and display means which is connected to said display signal-forming means, and comprises the patterns which are designed to visually indicate in a first color a condition of the master instrument which can be coped with without cutting off the power switch and a countermeasure for said condition and in a second color a condition of the master instrument which cannot be coped with, unless the power switch is cut off and a countermeasure for said condition, and, upon receipt of an output signal from said display signal-forming means, visually indicate, a pattern denoting a prescribed condition of the master instrument and a pattern representing a countermeasure for said condition in the first or second color.

As described above, a display device embodying this invention indicates a pattern denoting the prescribed condition of the master apparatus and also a pattern representing countermeasures to be taken for the prescribed condition both in accordance with the layout of the master apparatus. Furthermore, it displays the patterns in a first color when the condition of the master instrument can be coped with without cutting off a power switch and in a second color when the instrument condition cannot be coped with unless the power switch is cut off. Therefore, the subject display device enables even an unskilled operator to easily take proper countermeasures for a prescribed condition of the master apparatus.

BRIEF DESCRIPTION OF THE DRAWINGS

By way of example and to make the description clearer, reference is made to the accompanying drawings in which:

FIGS. 6A to 6E, 7A to 7G, 9A to 9E, 1OA to 1OG, 12A to 12D, 13A to 13G, 15A to 15D and 16A to 16G are timing charts showing the various operations of the subject display device.

DETAILED DESCRIPTION OF THE PREFERRED EMBODIMENT

Figure 1:
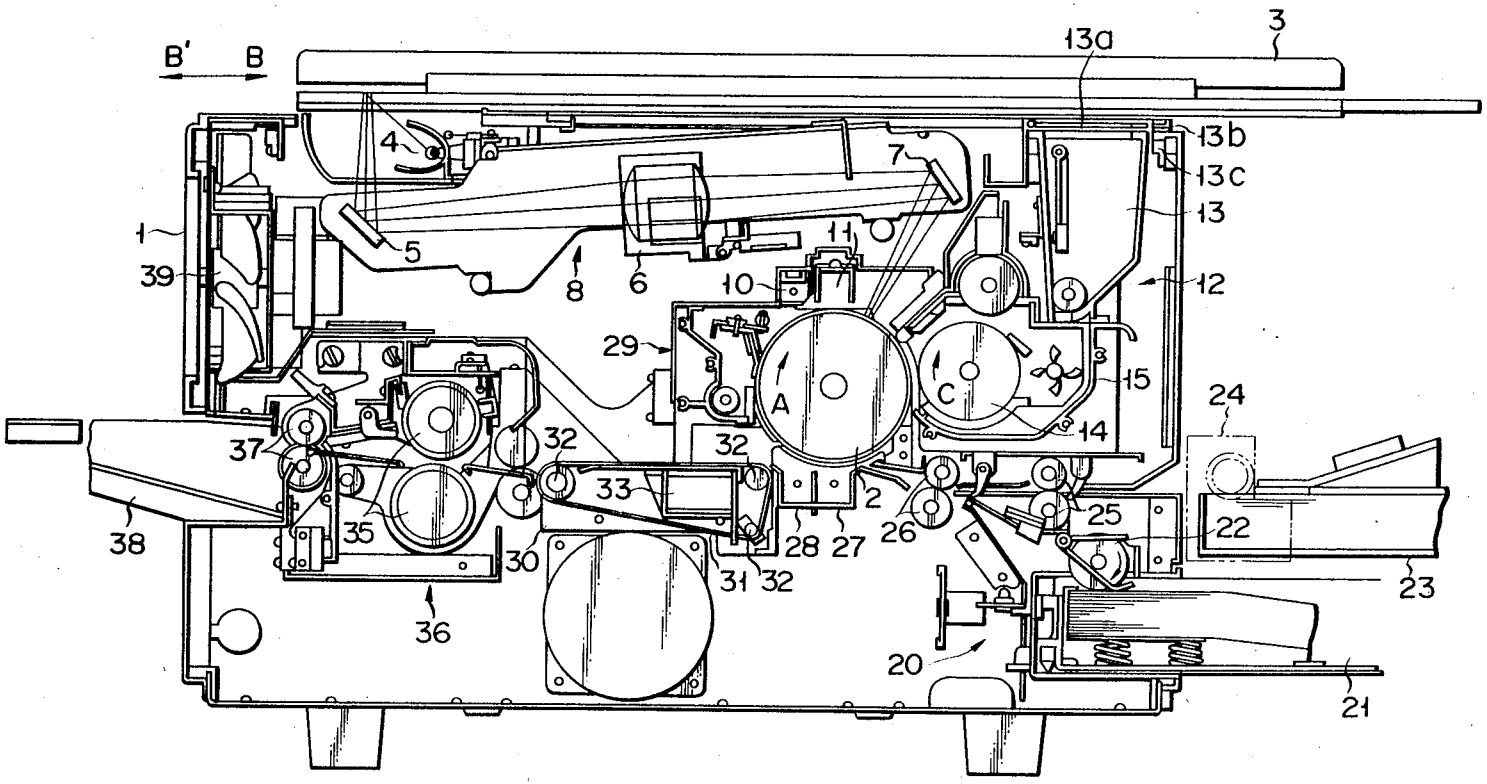
FIG. 1 is a schematic cross sectional view of a copying machine provided with a display device embodying this invention.

FIG. 1 is a schematic cross sectional view of a copying machine provided with a display device embodying this invention. A photosensitive member 2 is set in the substantially control part of a casing 1 of a copying machine. This photosensitive member 2 is coated with a selenium layer, and is made rotatable in a direction of an indicated arrow A. Fitted to the top of the casing 1 is an original sheet table 3 on which a sheet bearing an original impression is to be placed. The original sheet table 3 reciprocates in the directions indicated by arrows B′ and B. An exposure lamp 4 for illuminating the original sheet is provided below the original sheet table 3. A light is shed from end to end of the original sheet, as the original sheet table 3 moves on. Light beams reflected from the original sheet are projected on the surface of the photosensitive member 2 through a first mirror 5, lens unit 6 and second mirror 7 collectively constituting an exposure device 8. Arranged near the photosensitive member 2 are discharging lamp 10, for eliminating an electric charge accumulated on the surface of the photosensitive member 2, and a charging device 11, for electrically charging the surface of the photosensitive member 2. When the surface of the photosensitive member 2, which is charged after the preceding discharge, is exposed to a light emitted from the exposure device 8, then a latent image is formed on said surface. Set beyond the charging device 11 is a developing device 12 which renders the static latent image visible by a developing agent (hereinafter referred to as "a toner"). This developing device 12 comprises a toner hopper 13 for holding the toner and a magnetic brush developer 15 which uniformly spreads the toner supplied from the toner hopper 13 in fine particles over the surface of the photosensitive member 2 by means of a transport magnet roller 14 rotating in a direction indicated by arrow C. The developing device 12 is detachably received in the casing 1. A freely operable hopper cover 13*a* is mounted on the upper opening of the toner hopper 13. Further received in the casing 1 are a magnet 13*b* actuated in accordance with the opening and closing of the hopper cover 13*a* and a magnet switch 13*c* for detecting the opening and closing of the hopper cover 13*a* from the actuation of said magnet 13*b*. Set below the developing device 12 is a sheet feeder 20 for carrying a copy sheet to the underside of the photosensitive member 2. The sheet feeder 20 comprises a sheet-feeding cassette 21 which holds a plurality of copy sheets and is detachably positioned on a side of the casing 1 and a third sheet feed roller 22 for drawing out copy sheets from said sheet-feeding cassette 21 one after another. Above the sheet-feeding cassette 21 and detachably portioned on a side of the casing 1 is a sheet feed cassette 23 by means of a sheet feed mechanism 24. Said sheet feed cassette 23 enables sheets to be supplied either manually or by means of a cassette. Second sheet feed rollers 25, 25 are provided to carry forward a sheet drum from the sheet feed cassette 23. The sheet feeder 20 is provided with aligning rollers 26, 26 for transporting a sheet pulled out of the sheet feed cassette 21 or 23 with the leading end portion of said sheet secured in a proper position. Detachably provided beyond the sheet feeder 20 is a unit consisting of a transcription charger 27 for transposing a toner image formed on the surface of the photosensitive member 2 on to a sheet brought by the aligning rollers 26 and a separation charger 28 for releasing from the photosensitive member 2 a sheet on which a toner image has been transcribed. The photosensitive member 2 embodying this invention has an outer diameter of about 80 mm, thereby eliminating the necessity of providing a separation pawl as has been the case with the prior art when,a sheet is taken off the photosensitive member 2. Set beyond the separation charger 28 is a cleaning device 29 for recovering toner particles retained on the surface of the photosensitive member 2 after the transcription of a toner image on a copy sheet. The aforementioned discharging lamp 10 is fitted to the cleaning device 29 in a state length wise extending along part of the outer wall of the photosensitive member 2 at a prescribed distance therefrom. A suction sheet-carrying device 30 is provided to carry forward a sheet which has been taken off the photosensitive member 2 after the transcription of a toner image on said sheet. Said suction sheet-carrying device 30 is constructed by a plurality of flat belts 31, each of which is provided with a plurality of orifices and each of which is rotatably stretched over guide rollers 32, 32, 32. A suction duct 33 connected to a suction blower (not shown) is pressed against part of the inner wall of said flat belts 31. Therefore, a copy sheet is carried forward in a state adsorbed to the flat belts 31. Application of such suction sheet-carrying device 30 enables copy sheets of various sizes to be transported very easily. Moreover, air is guided through the suction duct 33, thereby also providing the effect of cooling the interior of the casing 1 and the ventilating efficiency therein.

A fixing device 36 is provided which is formed of heat rollers 35, 35 designed to fix a toner image transcribed on a copy sheet brought by the suction sheet-carrying device 30. A copy sheet on which a transcribed toner image is fixed is drawn into an external discharged copied sheet tray 38 through copied sheet-discharging rollers 37, 37. Reference numeral 39 given in FIG. 1 denotes an exhaust fan. The aforementioned exposure device 8, developing device 12, transcription charger 27, separation charger 28, cleaning device 29 and suction sheet-carrying device 30 are fully assembled into a unit. This unit is received in the casing 1 in an easily detachable state, thereby ensuring a reduction in the cost of manufacturing a copying machine and facilitating its maintenance.

Figure 2:
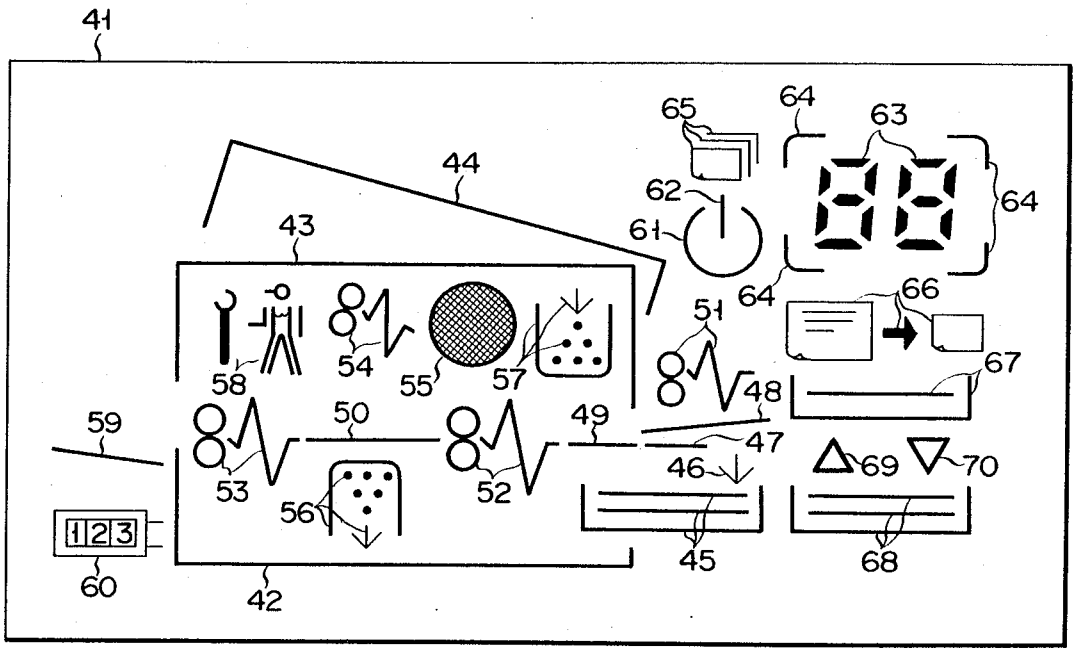
FIG. 2 shows the layout of various patterns impressed on the display panel of the display device of the invention.

FIG. 2 shows the layout of various patterns impressed on the display panel of the display device of this invention. The display panel is formed of a liquid crystal. In FIG. 2, a reference numeral 41 denotes a liquid crystal display panel; 42 a lower cover display segment; 43 a closed upper cover display segment; 44 an open upper cover display segment; 45 a sheet feed cassette segment; 46 a pictorial notation segment for indicating the absence of copy sheets in the sheet feed cassette; 47 a manual sheet feed table segment; 48, 49, 50 sheet passage segments; 51 a pictorial notation segment for indicating a manual sheet feed passage jammed with sheets; 52 a pictorial notation segment for indicating a sheet feed passage jammed with sheets; 53 a pictorial notation segment for indicating the fixing device 36 or a sheet passage nearby which is jammed with sheets; 54 a pictorial notation segment for indicating the photosensitive member 2 jammed with tightly wound sheets or the cleaning device 29 jammed with sheets carried thereinto; 55 a segment for indicating the photosensitive member 2 intended to produce a toner image; 56 a pictorial notation segment for indicating the cleaning device 29 fully filled with recovered toner particles; 57 a pictorial notation segment for indicating that the toner has all been drawn from the toner hopper 13 of the developing device 12; 58 a pictorial notation segment for indicating that the original sheet table 3 or drive motor has become immovable, requiring maintenance or repair by a serviceman; 59 a segment for indicating a tray into which copied sheets are collected; 60 a pictorial notation segment for indicating that a key counter has been rendered ready for operation; 61 a pictorial notation segment for indicating that full preparation has been made for the copying operation; 62 a pictorial notation segment, which, with the aid of said segment 61, shows that the copying machine has failed; 63 a 2-digits segment for indicating the number of copied sheets; 64 a pictorial notation segment for indicating an enclosure in which a number of copied sheets is to be displayed; 65 a pictorial notation segment for indicating that the displayed two digits denote the number of copied sheets; 66 a pictorial notation segment for indicating that an image outline has been reduced in conformity to the size of a copy sheet used; 67 a pictorial notation segment for indicating an upper copy sheet cassette already holding copy sheets; 68 a pictorial notation segment for indicating a lower copy sheet cassette already holding copy sheets; 69 a pictorial notation segment for indicating that the upper copy sheet cassette has been selected for use; and 70 a pictorial notation segment for indicating that the lower copy sheet cassette has been selected for use. A common electrode (not shown) is provided at the back of the respective segments. Some, (for example, 42, 47, 59) of the above listed segments are connected together, in the display element 41 of FIG. 2, to be lighted by the same signal.

A light from a light source is projected on the respective segments through a color filter. Before being impressed with voltage the whole of each segment presents a color (for example, a black color) peculiar to the color element of said color filter. When looking through the color filter, the operator can recognize the color of that part of the color filter which faces a segment impressed with voltage. A yellow color filter (not shown) is so set as to face the sheet feed cassette segment 45 and pictorial notation segments 46, 51, 60, 62, which, therefore, are displayed in yellow. A red color filter (not shown) is so positioned as to face the pictorial notation segments 52, 53, 56, 58, which, therefore, are displayed in red.

Figure 3:
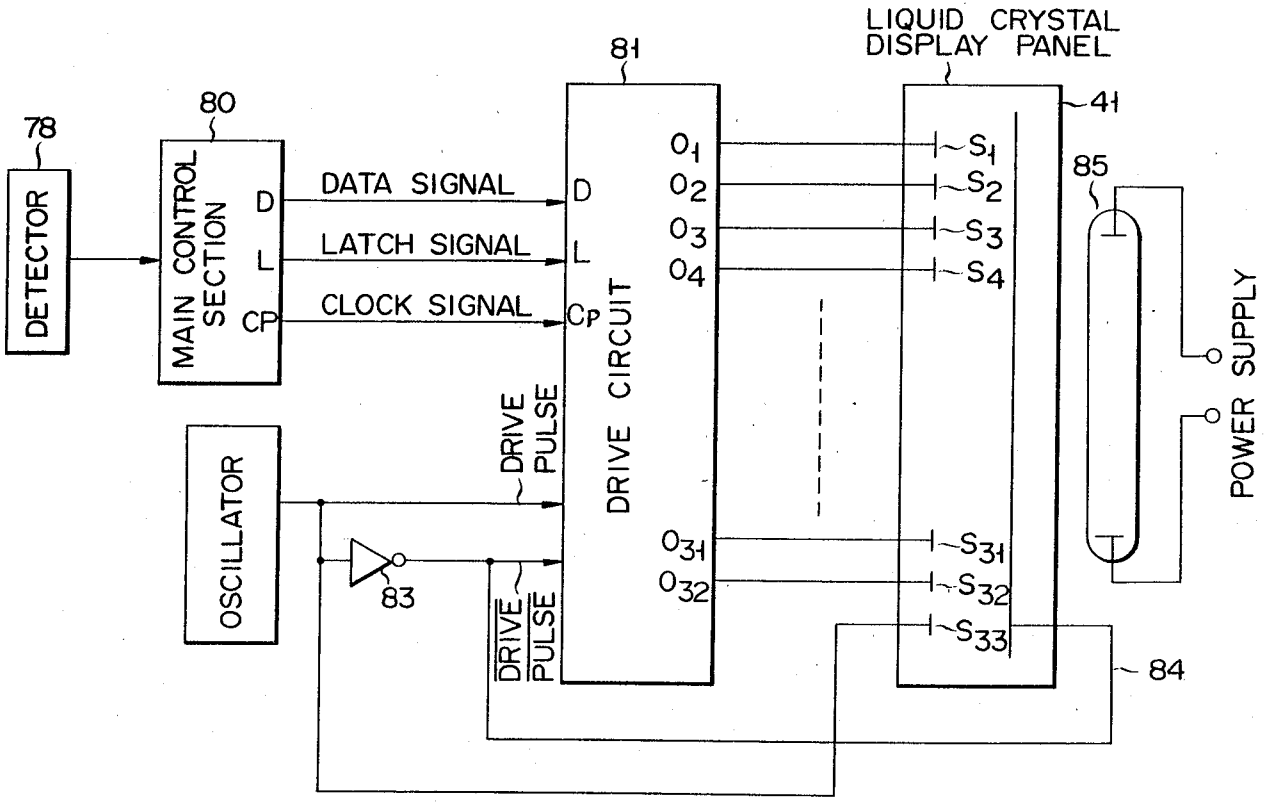
FIG. 3 is a schematic block circuit diagram of the display device of the invention.

FIG. 3 is a schematic block circuit diagram of the display device embodying this invention. Reference numeral 78 denotes a plurality of detectors which are set at those spots of the copying machine of FIG. 1 at which the prescribed conditions thereof are to be detected. Reference numeral 80 represents a main control section, which controls the operation of the body of the copying machine and converts output signals from the respective detectors into [1, 2, 4, 8] weighted binary code signals, and delivers said converted binary code signals to an output terminal D, of the main control section 80.

Figure 4:
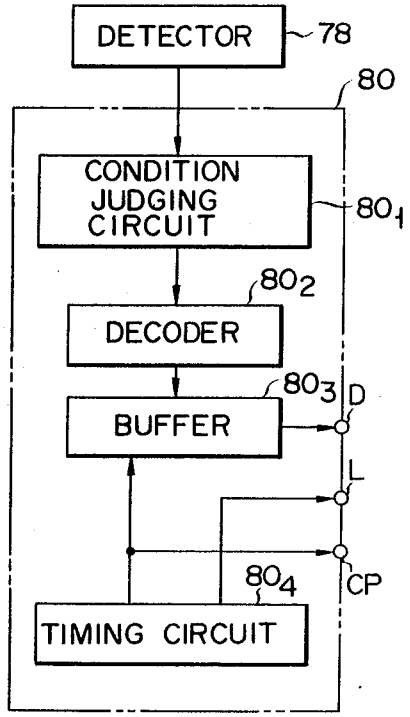
FIG. 4 is a schematic block circuit diagram of the main control section of the display device of FIG. 3.

FIG. 4 is a schematic block circuit diagram of the main control section 80 of the display device of FIG. 3. A copying machine condition-judging circuit $\mathbf{80_1}$ (hereinafter referred to as "a condition-judging circuit") judges a given condition of the copying machine according to the contents of an output signal from the corresponding detector 78, and sends forth a signal denoting the result of said judgment. A decoder $\mathbf{80_2}$ converts a received judgment signal into a binary code signal. Table 1 below indicates the judged conditions and the corresponding output binary code signals from the decoder $\mathbf{80_2}$.

TABLE 1

| Judged Condition | Decoder Output | | | | | | | | | | | | | | | | | | | | | | | | |
|---|---|---|---|---|---|---|---|---|---|---|---|---|---|---|---|---|---|---|---|---|---|---|---|---|---|
| | 1 2 3 4 5 6 7 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| Standby | 0 0 0 0 0 0 0 0 | 0 | 0 | 0 | 0 | 1 | 1 | 0 | 0 | 0 | 0 | 1 | 1 | 1 | 1 | 1 | 1 | 0 | 0 | 0 | 0 | 0 | 0 | 0 | 0 |
| Ready | 0 0 0 0 0 0 0 0 | 0 | 0 | 0 | 0 | 1 | 0 | 0 | 0 | 0 | 0 | 0 | 1 | 1 | 0 | 0 | 0 | 0 | 0 | 0 | 0 | 0 | 0 | 0 | 0 |
| No copy Sheet | 1 1 0 1 0 0 0 0 | 0 | 0 | 0 | 0 | 1 | 0 | 0 | 0 | 0 | 0 | 1 | 1 | 1 | 1 | 1 | 1 | 1 | 0 | 0 | 0 | 0 | 0 | 0 | 0 |
| Paper Jamming in Supply Unit | 1 0 1 0 1 0 0 0 | 0 | 0 | 0 | 0 | 0 | 0 | 0 | 0 | 0 | 0 | 1 | 0 | 1 | 1 | 1 | 1 | 1 | 0 | 0 | 0 | 0 | 0 | 0 | 0 |
| Key Counter | 1 1 0 0 0 0 0 0 | 0 | 0 | 0 | 1 | 0 | 0 | 0 | 0 | 0 | 0 | 1 | 1 | 1 | 1 | 1 | 1 | 1 | 1 | 1 | 1 | 1 | 1 | 1 | 1 |
| No Toner | 1 1 0 0 0 0 0 1 | 0 | 0 | 0 | 0 | 1 | 0 | 0 | 0 | 0 | 0 | 1 | 1 | 1 | 1 | 1 | 1 | 1 | 1 | 1 | 1 | 1 | 1 | 1 | 1 |
| Filled with Recovered toner | 1 1 0 0 0 0 0 0 | 0 | 0 | 1 | 0 | 0 | 0 | 0 | 0 | 0 | 0 | 1 | 1 | 1 | 1 | 1 | 1 | 1 | 1 | 1 | 1 | 1 | 1 | 1 | 1 |
| Call for Serviceman | 0 0 0 0 0 0 0 0 | 0 | 1 | 0 | 0 | 0 | 0 | 0 | 0 | 0 | 0 | 1 | 1 | 1 | 1 | 1 | 1 | 1 | 1 | 1 | 1 | 1 | 1 | 1 | 1 |
| Wrong Paper Separation from Member | 1 0 1 0 0 0 0 0 | 1 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 |
| Paper Jamming in Discharge Unit | 1 0 1 0 0 1 0 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 |

A buffer $\mathbf{80_3}$ temporarily holds an output binary code signal from the decoder $\mathbf{80_2}$. A timing circuit $\mathbf{80_4}$ sends forth clock signals and also latch signals in synchronization with the prescribed ones of the clock signals. The display device is operated in synchronization with the prescribed ones of the clock signals. Data temporarily held in the buffer $\mathbf{80_3}$ is issued in synchronization with an output clock signal from the timing circuit $\mathbf{80_4}$. The main control circuit 80 is formed of, for example, a microcomputer.

Reference numeral 81 denotes a liquid crystal drive circuit, whose input terminal D receives data signals from the main control circuit 80, each time a clock signal is supplied to the input terminal $C_P$ of said liquid crystal drive circuit 81. Reference numeral 82 represents an oscillation circuit which oscillates signals in an optimum frequency for the drive of the liquid crystal. The oscillation circuit generates a DRIVE PULSE signal, and an inverter circuit 83 sends forth an inverted $\overline{\text{DRIVE PULSE}}$ signal. This inverted $\overline{\text{DRIVE PULSE}}$ signal is supplied to the liquid crystal drive circuit 81.

The output terminals O1 to O32 of the liquid drive circuit 81 issue output signals corresponding to the segments S1 to S32 of a liquid crystal display element received in the liquid crystal display panel 41. An output drive pulse from the oscillation circuit 82 is delivered to the segment S33 of the liquid crystal display element. An output inverted $\overline{\text{DRIVE PULSE}}$ signal from the inverter circuit 83 is supplied to a common electrode 84 provided for the segments S1 to S33.

Figure 5:
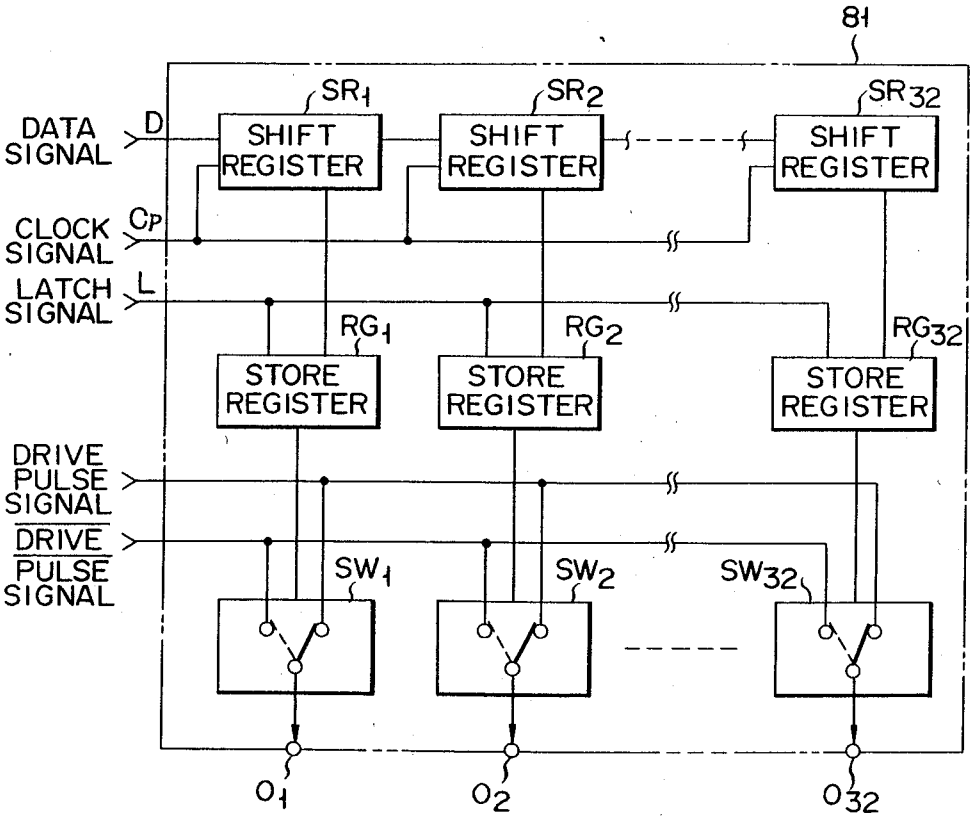
FIG. 5 is a schematic block circuit diagram of the liquid crystal drive circuit included in the display device of FIG. 3.

FIG. 5 is a schematic block circuit diagram of the liquid crystal drive circuit 81. Data signals supplied from the input terminal D are supplied in succession to the thirty-two shift registers SR1 to SR32, each time a clock pulse is delivered to the input terminal $C_P$. Directly connected to said shift registers SR1 to SR32 are store registers RG1 to RG32 for holding the contents of said shift registers SR1 to SR32 upon receipt of a latch signal from the input terminal L. The store registers RG1 to RG32 control the operation of thirty-two switches SW1 to SW32 according to the contents stored in said store registers RG1 to RG32, and supply a DRIVE PULSE signal or inverted $\overline{\text{DRIVE PULSE}}$ signal to output terminals 01 to 032. When the contents of some of the store registers RG1 to RG32 have a logic level "1", then a DRIVE PULSE signal is issued to the corresponding output terminals. When the contents of some of the store registers RG1 to RG32 have a logic level "0", then an inverted $\overline{\text{DRIVE PULSE}}$ signal is sent forth to the corresponding output terminals. The shift register SR1, store register RG1, switch SW1 and output terminal O1 correspond to each other. Similarly, the other thirty-one shift registers SR2 to SR32, thirty-one store registers RG2 to RG32, thirty-one switches SW2 to SW32 and thirty-one output terminals O2 to O32 correspond to each other. Reference numeral 85 denotes a cooled cathode discharge tube. When a light is allowed to pass through a color filter (not shown) from below the liquid crystal display panel 41, then the color of said color filter is displayed.

Figure 6:
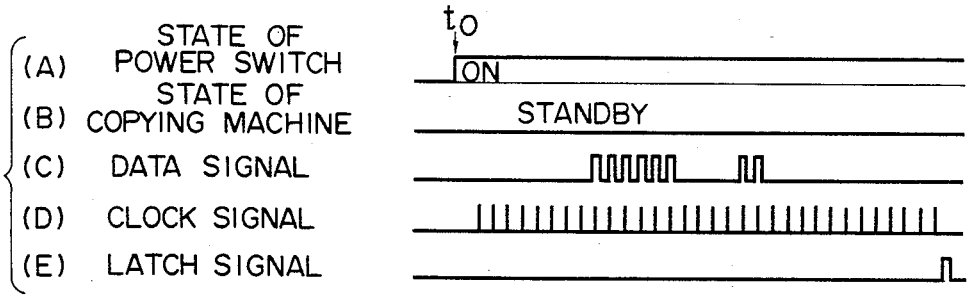
Figure 7:
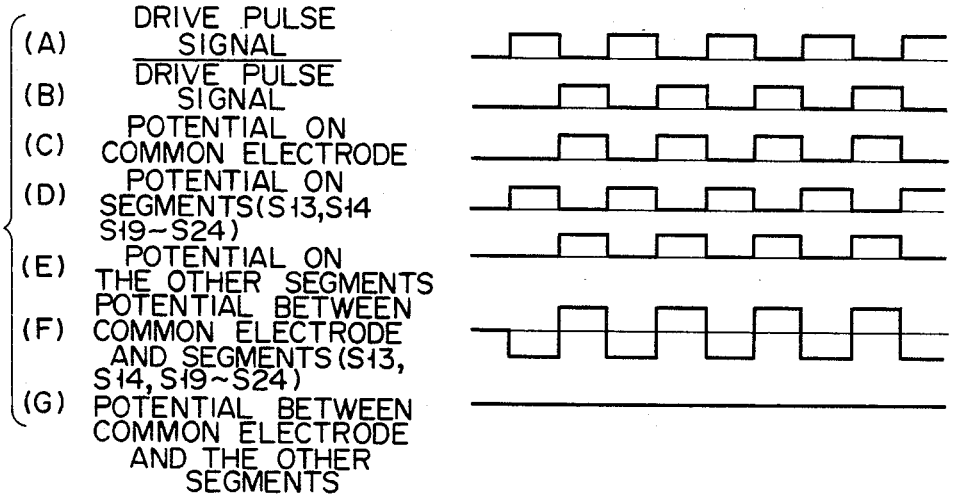
Figure 8:
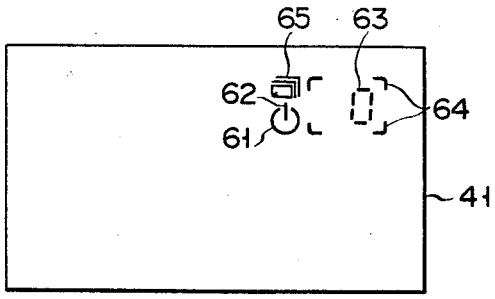
FIGS. 8, 11, 14, 17 and 18 to 25 indicate the patterns representing the various conditions of a copying machine which are previously impressed on a liquid crystal display panel.

Description is now given with reference to FIGS. 6 and 7 of the operation of a display device embodying this invention. When the power switch of a copying machine (not shown) is rendered conducting at time t0 (FIG. 6A), then the main control section 80 is operated in the previously programmed order. The main control section 80 causes a fixing heater to be supplied with power. At this time the fixing device 36 is not yet sufficiently heated to carry out fixing (FIG. 6B). Therefore, the main control section 80 sends forth a binary code signal [0000 0000 0000 1100 0011 1111 0000 0000] denoting a standby state (a state in which copying operation is impossible) indicated in Table 1 (said binary code signal is hereinafter referred to as "a data A signal") in synchronization with the prescribed ones of clock signals sent forth from the output terminal $C_P$.(FIGS. 6C and 6D). When the transfer of the data of the last 32nd bit is brought to an end, the main control section 80 issues a latch signal (FIG. 6E). As a result, the bits of the data A signal are held in the store registers RG1 to RG32 of the liquid crystal drive circuit 81. DRIVE PULSE signals (FIG. 7A) are issued from the output terminals O13, O14, O19, O20, O21, O22, O23, O24 corresponding to store registers RG13, RG14, RG19, RG20, RG21, RG22, RG23, RG24 where contents are set at a logic level "1". These DRIVE PULSEs are supplied to the corresponding segments S13, S14, S19, S20, S21, S22, S23, S24 shown on the liquid crystal display panel 41 (FIG. 7D). Inverted $\overline{\text{DRIVE PULSE}}$s (FIG. 7B) are sent forth from the output terminals of the remainder (whose contents are set at a logic level "0") of the thirty-two store registers obtained by excluding the aforementioned store registers RG13, RG14, RG19, RG20, RG21, RG22, RG23, RG24. Said inverted $\overline{\text{DRIVE PULSE}}$s are supplied to the other segments than the previously described segments of the liquid crystal display panel 41. The common electrode 84 (FIG. 3) is supplied with an inverted $\overline{\text{DRIVE PULSE}}$ signal (FIG. 7C). As shown, therefore, in FIG. 7F, a voltage signal having a level equal to a difference between the level of FIG. 7D and the level of FIG. 7C is impressed between the common electrode 84 and the segments S13, S14, S19, S20, S21, S22, S23, S24, which in turn are lighted. In contrast, a voltage signal having the same level (FIGS. 7C and 7E) as impressed between the common electrode 84 and the other segments of the thirty-two segments. As shown in FIG. 7G, therefore, no potential difference appears between the common electrode 84 and the remainder of the thirty-two segments arrived at by subtracting the aforesaid segments S13, S14, S19, S20, S21, S22, S23, S24, thereby preventing said remainder of the thirty-two segments from being lighted. The same A. C. voltage as shown in FIG. 7F is impressed between the common electrode 84 and the segment S33 which is always supplied with a DRIVE PULSE signal. Therefore said segment S33 always remains lighted. As seen from FIG. 8, therefore, there are lighted pictorial notation display segments 61, 62, and lighted digit display segments 63, 64, 65 corresponding to the segments S13, S14, S19, S20, S21, S22, S23, S24. The display pattern of FIG. 8 shows that the copying machine remains in a standby state, that is, a state in which it is impossible to conduct a copying operation.

Figure 9:
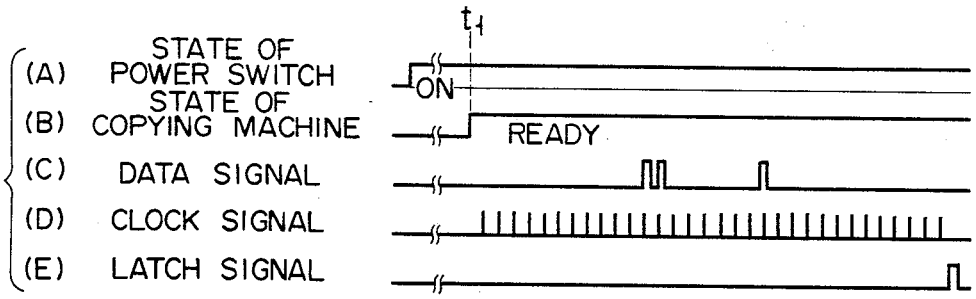
Figure 10:
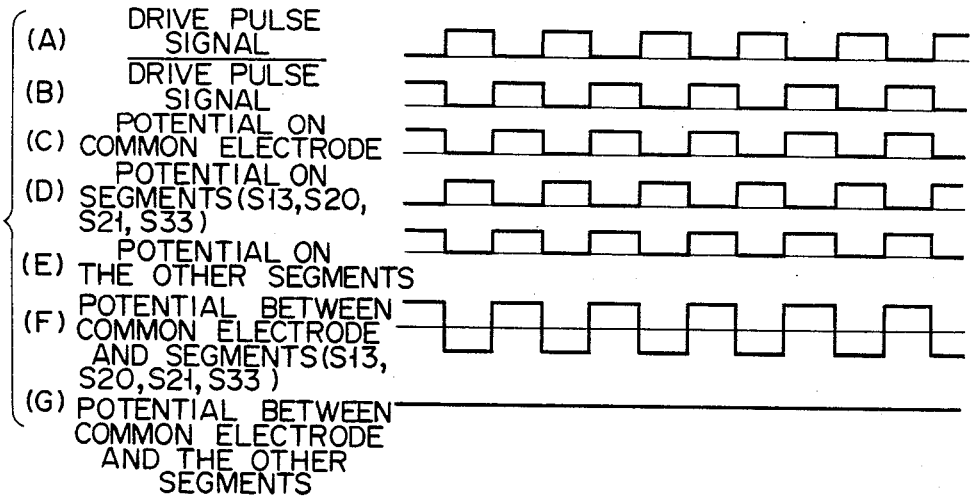
Figure 11:
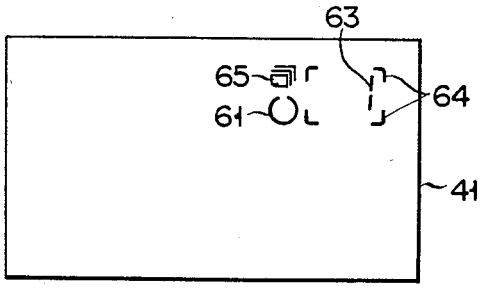

When, after the standby state, the copying machine is sufficiently heated for fixing at time t1 and rendered ready for a copying operation (FIG. 9B), then the main control section 80 causes a binary code signal denoting full preparation for a copying operation which is represented by binary codes [0000 0000 0000 1000 0001 1000 0000 0000] as shown in Table 1 (said binary code signal is hereinafter referred to as "a data B signal") to be issued in synchronization with the prescribed ones of clock signals sent forth from the output terminal $C_P$ (FIGS. 9C and 9D). When the transfer of the data of the last 32nd bit is brought to an end, a latch signal is produced from the output terminal L. As a result, the data B signal is held in the store registers RG1 to RG32 of the liquid crystal drive circuit 81, causing a DRIVE PULSE signal to be sent forth from the output terminals O13, O20, O21 corresponding to those store registers which store a signal having a logic level "1". The DRIVE PULSEs are respectively supplied to the corresponding segments S13, S20, S21 of the liquid crystal display panel 41. An inverted $\overline{\text{DRIVE PULSE}}$ signal is issued from the other output terminals corresponding to those store registers which store a signal having a logic level "0". As previously described, the common electrode 84 is supplied with an inverted $\overline{\text{DRIVE PULSE}}$s (FIG. 3), and the segment S33 is supplied with a DRIVE PULSE signal. As shown, therefore, in FIG. 10F, a voltage signal having a level equal to a difference between the level of the common electrode 84 and the level of the segments S13, S20, S21, S33 is supplied, causing said segments S13, S20, S21, S33 to be lighted. A voltage signal having the same phase is impressed between the common electrode 84 and the other segments of those described above, thereby giving rise to no potential difference as illustrated in FIG. 10G. Consequently the segments other than the aforementioned segments S13, S20, S21, S33 are prevented from being lighted. At this time, a pictorial relation display segment 61, digit display segment 63 and segments 64, 65 are lighted, thereby indicating that the copying machine has been made fully ready for a copying operation and that a number of copy sheets to be copied during a prescribed length of time is, for example, one, as illustrated by a digit "1" represented by said digit display segment 63.

Figure 12:
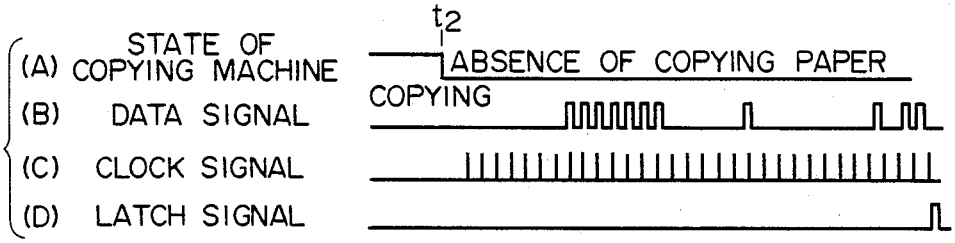
Figure 13:
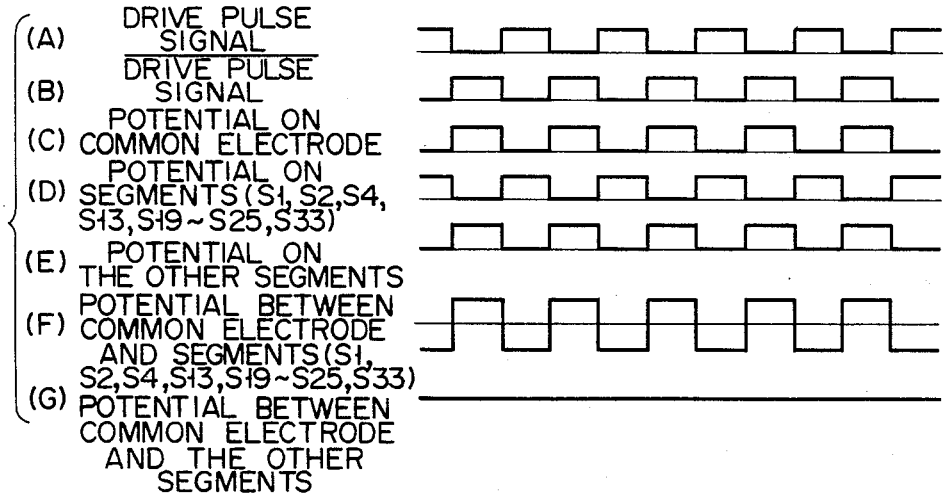
Figure 14:
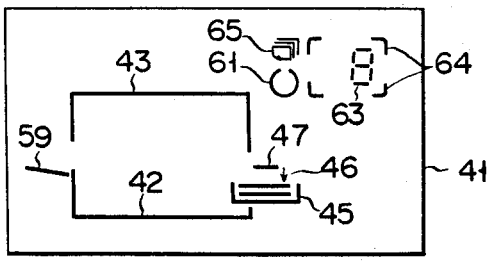

When, as shown in FIG. 12A, copy sheets have all been drawn off from the sheet feed cassette 21 at time t2 during a copying operation and a detecting means (not shown) finds this event, then the main control section 80 stops the operation of the copying machine, and supplies to the output terminal D a binary code signal shown in Table 1 as [1101 0000 0000 1000 0011 1111 1000 0000] which denotes the absence of copy sheets in the cassette 21 (FIGS. 12B, 12C and 12D). As a result, there is supplied a voltage signal having a level equal to a difference between the level of the common electrode 84 and the level of the segments S1, S2, S4, S13, S19, S20, S21, S22, S23, S24, S25 and S33. Therefore these segments are lighted, and the other segments are prevented from being lighted. At this time, upper and lower cover segments 43, 42, manual sheet feed table display segment 47, tray display segment 59, pictorial notation display segment 61, digit display segment 63 and other segments 64, 65 are lighted. Further, the sheet feed cassette display segment 45 and pictorial notation display segment 46 are intermittently displayed in yellow, thereby indicating that copy sheets have all been drawn off from the copying machine. The shift registers SR19 to SR32 and store registers RG19 to RG32 of the liquid crystal display drive circuit 81 are used to indicate a number of copied sheets. In the above-mentioned example of FIG. 14 a number of "1" is subtracted from the digit represented by the digit display segment 63, each time one copy sheet is copied. Therefore, the digit "8" denoted by said digit display segment 63 means that copy sheets have all been drawn off from the sheet feed cassette 21, though eight more copy sheets have to be copied.

Figure 15:
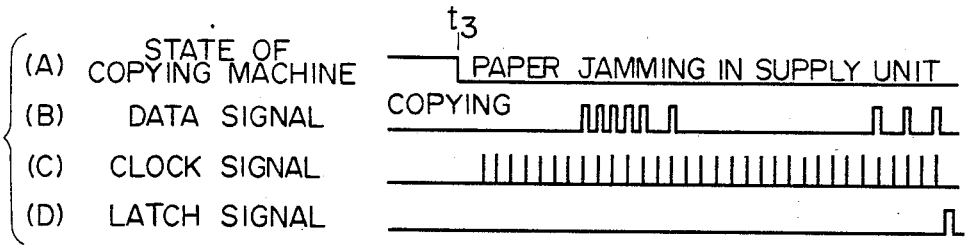
Figure 16:
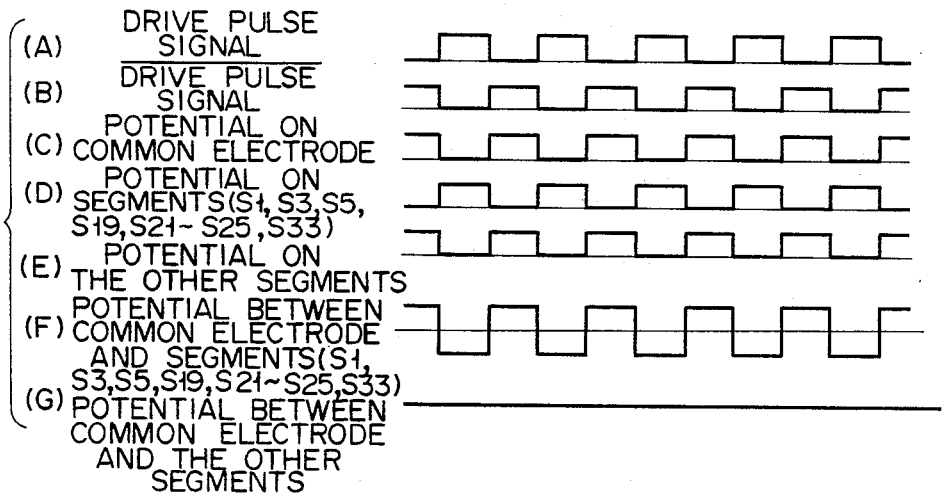
Figure 17:
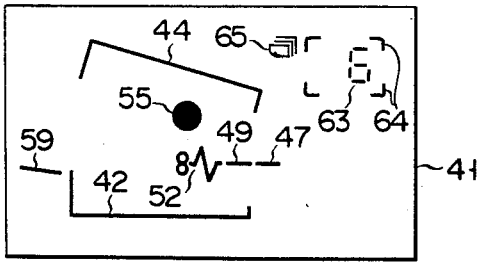

When, at time t3 (FIG. 15A) during the copying operation, copy sheets supplied from a sheet feed cassette (not shown) are jammed immediately after their feeding, and this event is detected by detection means (not shown), then the main control section 80 stops the operation of the copying machine in accordance with a program, and delivers to the output terminal D a binary code signal denoting the jamming of copy sheets, as [1010 1000 0000 0000 0010 1111 1000 0000] shown in Table 1 (FIGS. 15B, 15C and 15D). As a result there is supplied a voltage signal having a level equal to a difference between the level of the common electrode 84 and the level of the segments S1, S3, S5, S19, S21, S22, S23, S24, S25, S33, causing these segments to be lighted and preventing the other segments from being lighted. At this time, the upper and lower cover display segments 44, 42, photosensitive member display segment 55, tray display segment 59, digit display segment 63, and other segments 64, 65 are lighted as shown in FIG. 17. Further, the manual sheet feed table display segment 47, and sheet passage display segment 49 are intermittently displayed in yellow, and the pictorial notation display segment 52 is intermittently displayed in red. Thus, the jamming of sheets has occurred in the copying machine. As seen from FIG. 17, the upper cover of the copying machine which has been closed up to this time is now shown to be opened. In the case of FIG. 17, the jamming of copy sheets has taken place, when for example, six more sheets have to be copied.

As described above, the main control section 80 causes a binary code signal (shown in Table 1) corresponding to a prescribed condition of a copying machine to be issued to the liquid crystal drive circuit 81 upon receipt of an output signal from a detector positioned at that part of the copying machine where its prescribed condition is to be recognized. As a result, a desired pattern is shown on the liquid crystal display panel 41.

Figure 19:
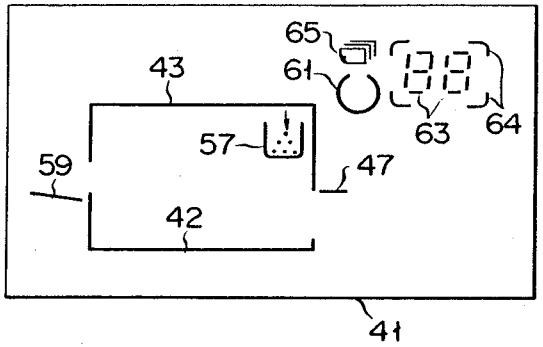
Figure 21:
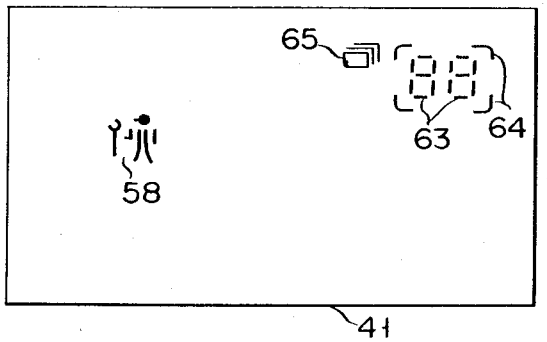
Figure 18:
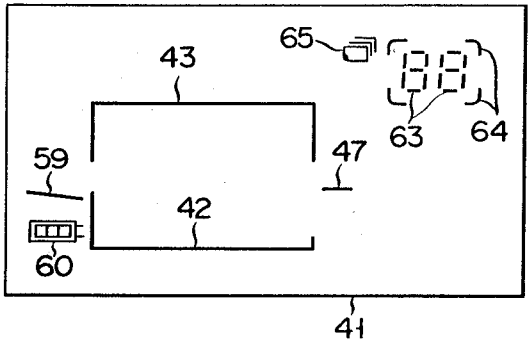
Figure 20:
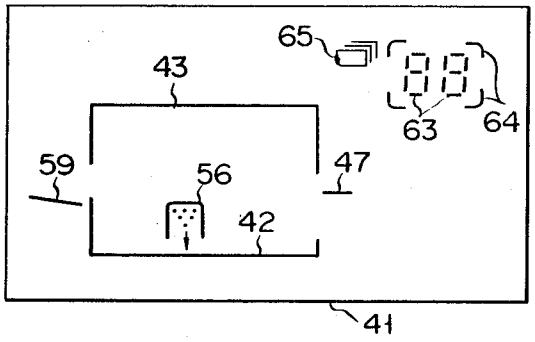
Figure 23:
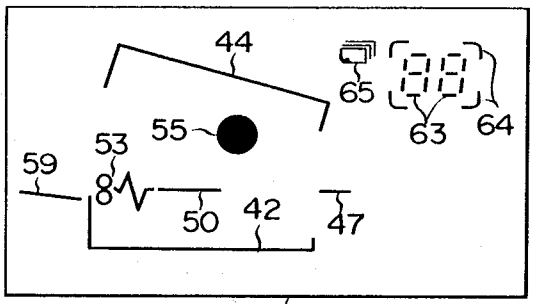
Figure 25:
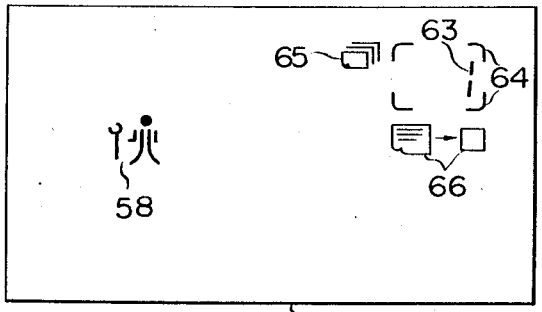
Figure 22:
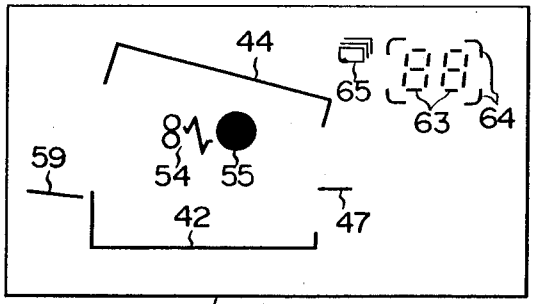
Figure 24:
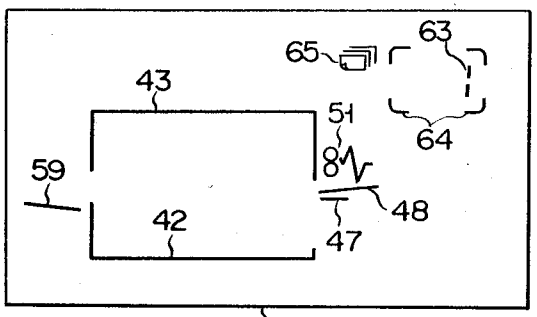

When a key counter is not set in a copying machine which can not carry out a copying operation under such condition, then the upper and lower cover display segments 43, 42, manual sheet feed table display segment 47, tray display segment 59, digit display segment 63 and other segments 64, 65 are lighted, and a pictorial notation display segment 60 is intermittently displayed in yellow (FIG. 18). The above-mentioned operation is used to indicate that the setting of the key counter is commanded, and the copying machine still remains incapable of a copying operation. When the toner is all drawn from the toner hopper 13, then the upper and lower cover display segments 43, 42, manual sheet feed table display segment 47, tray display segment 59, pictorial notation display segment 61, digit display segment 63 and the associated segments 64, 65 are lighted, and the pictorial notation display segment 57 is intermittently displayed in yellow (FIG. 19). The above-mentioned operation is used to indicate the absence of the toner in the toner hopper 13. When the cleaning device 29 is fully filled with recovered toner particles, then the upper and lower cover display segments 43, 42, manual sheet feed table display segment 47, tray display segment 55, digit display segment 63 and the other associated segments 64, 64 are lighted, and further a pictorial notation display segment 56 is intermittently displayed in yellow (FIG. 20). The above-mentioned operation is used to indicate that the discharge of recovered toner particles is pictorially instructed. When the motor (not shown) or the original sheet table 3 happens to become immovable, then a digit display segment 63 and the associated segments 64, 65 are lighted, and further a pictorial notation display segment 58 is intermittently displayed in red (FIG. 21). The above-mentioned operation is used to indicate that a demand is pictorially instructed for the call of a serviceman. When a copied sheet fails to be released from the surface of the photosensitive member 2, then the upper and lower cover display segments 44, 42, manual sheet feed table display segment 47, photosensitive member display segment 55, tray display segment 59, digit display segment 63 and the associated segments 64, 65 are lighted, and further a pictorial notation display segment 54 is displayed in red (FIG. 22). The above-mentioned operation is used to indicate that a copied sheet has failed to be taken off the photosensitive member, and the copying machine has become incapable of performing a copying operation. When sheet jamming arises in the fixing device 36, or sheet passage, then the upper and lower cover display segments 44, 42, manual sheet feed table display segment 47, photosensitive member display segment 55, tray display segment 59, digit display segment 63, and the associated segments 64, 65 are lighted, and further a sheet passage display segment 50 and a pictorial notation display segment 53 are intermittently displayed in red (FIG. 23). The above-mentioned operation is used to indicate that sheet jamming has taken place in the aforesaid fixing device 36 or sheet passage. When sheet jamming occurs in a manual sheet feed guide, then the upper and lower cover display segments 43, 42, manual sheet feed table display segment 47, sheet passage 48, tray display segment 59, digit display segment 63, and the associated segments 64, 65 are lighted, and further a pictorial notation display segment 51 is intermittently displayed in yellow (FIG. 24). The above-mentioned operation is used to indicate that sheet jamming has occurred in the manual sheet feed guide. When a lens system fails to take a position where the original impression is to be magnified or reduced in size, then the digit display segment 63 and the associated segments 64, 65 are lighted, and further another display segment 66 is intermittently displayed in green, and a pictorial rotation display segment 58 is intermittently displayed in red. The above-mentioned operation is used to indicate that a demand for the call of a serviceman is pictorially instructed.

A display device embodying this invention which is arranged as described above has the advantages that the various conditions of a copying machine can be accurately and concretely indicated; when sheet jamming arises, or a copied sheet fails to be released from the surface of a photosensitive member, then the operator can easily judge whether the upper cover should be opened or can be left closed or whether the power switch should be cut off or can remain conducting in order to resolve the above mentioned abnormal conditions; the operator can become accustomed to the operation of the copying machine and consequently carry out the copying work more quickly than has been possible in the past; and not only an accurate and distinct instruction can be given but also a proper easily understandable display can be made to the operator with respect to an abnormal condition of the copying machine.

The foregoing description refers to the case where the display element was formed of a liquid crystal. However, the same effect can be assured, even if any other light-emitting element such as a light-emitting diode is jointly used with a well-matched drive device. The liquid crystal display element can be so arranged to make a positive or negative display. Description was given of the case where the display device of the invention was applied to indicate the conditions of an ordinary electronic copying machine. However, the subject display device is not limited to said application, but can be used to display the various conditions of an electronic printer, facsimile transceiver or image-detecting device which has a construction similar to that of said ordinary electronic copying machine. The point is that the display device of the invention is applicable to any instrument where a movable section is so operated by the user as to meet the need. Obviously, this invention can be applied in various modifications without departing from the object described above.

What is claimed is:

1. A color coded copier display device for an electrophotographic copying machine having movable parts said device comprising:

a plurality of detection means for detecting predetermined conditions of the electrophotographic copying machine, condition-judging means for deciding a particular condition of the copying machine upon receipt of an output signal from any of said detection means, display means having a plurality of display segments representing graphically conditions of said copying machine and corresponding countermeasures if the conditions are malfunctions, said display segments having first color patterns representing critical malfunction conditions of the copying machine and second color patterns representing non-critical malfunction conditions of the copying machine, and display signal forming means for supplying a display drive signal to said display means, said display drive signal corresponding to at least one of the critical and non-critical malfunction conditions, and the corresponding countermeasure thereof, in conformity with an output of said condition-judging means to allow at least one of the first and second color patterns representing at least one of the critical and non-critical malfunction conditions and the countermeasure thereof to be displayed on said display means, said display signal forming means comprising:

(a) display signal-generating means connected to said condition-judging means for sending forth a binary code signal to display a given condition of said copying machine and a countermeasure to cope with said condition;

(b) timing circuit means for generating clock signals for synchronizing the various operations of the display device and also for sending forth a latch signal in synchronization with a prescribed one of said clock signals;

(c) signal-holding means connected to said display signal-generating means and timing circuit means, for temporarily holding an output binary code signal from said display signal-generating means, and for producing an output signal upon receipt of a clock signal from said timing circuit means; and (d) drive circuit means connected to said signal-holding means and timing circuit means, for receiving a binary code signal in synchronization with a particular clock signal, and, when data has been received on a particular condition of said copying machine, for holding data represented by the binary code signal upon receipt of a latch signal, and for sending forth a drive signal according to the contents of the temporarily held data, said drive circuit means being connected with a drive signal-generating circuit for generating said drive signal and including: a plurality of shift registers for temporarily holding an output binary code signal from said signal-holding means; store registers corresponding to the plurality of shift registers, which upon receipt of a latch signal, store data read out of the corresponding shift registers; and a switching circuit which receives an output drive signal from the drive signal-generating circuit, and sends forth a drive signal in conformity to the contents of the data stored in the store registers.

2. A display device according to claim 1, wherein said display means is formed of a liquid crystal display.

3. A display device according to claim 1, wherein the first color is yellow and the second color is red.

4. A display device according to claim 1, wherein said display segments include graphical patterns representing the moving state of the movable parts of said copying machine.

* * * * *